US010795300B2

(12) United States Patent
Oyoshi

(10) Patent No.: US 10,795,300 B2
(45) Date of Patent: Oct. 6, 2020

(54) IMAGE FORMING APPARATUS

(71) Applicant: CANON KABUSHIKI KAISHA, Tokyo (JP)

(72) Inventor: Kazuhiro Oyoshi, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/724,802

(22) Filed: Dec. 23, 2019

(65) Prior Publication Data

US 2020/0218185 A1 Jul. 9, 2020

(30) Foreign Application Priority Data

Jan. 7, 2019 (JP) ..... 2019-000644
Nov. 6, 2019 (JP) ..... 2019-201765

(51) Int. Cl.
*G03G 15/00* (2006.01)
*G03G 15/16* (2006.01)
*G03G 15/01* (2006.01)

(52) U.S. Cl.
CPC ..... *G03G 15/5004* (2013.01); *G03G 15/5037* (2013.01); *G03G 15/0189* (2013.01); *G03G 15/1645* (2013.01); *G03G 2215/0177* (2013.01)

(58) Field of Classification Search
CPC ..... G03G 15/5004; G03G 15/5037; G03G 15/1645; G03G 15/0189; G03G 2215/0177
See application file for complete search history.

(56) References Cited

U.S. PATENT DOCUMENTS 4,994,852 A * 2/1991 Matsuuchi ..... G03G 15/2003 219/216
5,911,094 A * 6/1999 Tsujimoto ..... G03G 15/2039 219/619
9,268,280 B2 * 2/2016 Shimura ..... G03G 15/205
2002/0098006 A1 * 7/2002 Tamaoki ..... G03G 15/2003 399/69
2011/0274450 A1 * 11/2011 Atarashi ..... G03G 15/80 399/37
2012/0141150 A1 * 6/2012 Noh ..... G03G 15/55 399/33
2018/0217545 A1 * 8/2018 Gonzalez ..... H03K 17/102
2020/0145542 A1 * 5/2020 Obata ..... G03G 15/5004

FOREIGN PATENT DOCUMENTS

JP 2004-282893 10/2004

* cited by examiner

*Primary Examiner* — G. M. A Hyder
(74) *Attorney, Agent, or Firm* — Venable LLP

(57) ABSTRACT

An image forming apparatus includes a power supply board, a driver board, and an engine control board. The driver board includes a plurality of switching elements each configured to supply and shut off a power supply for each of a plurality of distributed power supply voltages supplied from the power supply board. The plurality of switching elements includes a first switching element, to which the power supply voltage is to be applied from the power supply board, and a second switching element, to which the power supply voltage output from the first switching element is to be applied in a distributed manner. The engine control board is configured to performs failure diagnosis of the first switching element when the image forming apparatus is activated, and performs failure diagnosis of the second switching element in a case where an abnormality has occurred in any one of a plurality of loads.

11 Claims, 9 Drawing Sheets

IMAGE FORMING APPARATUS

BACKGROUND OF THE INVENTION

Field of the Invention

The present disclosure relates to a technology of identifying, when an abnormality has occurred in operation of an image forming apparatus such as a copying machine or a printer, a failure portion, which is a cause of the abnormality.

Description of the Related Art

An image forming apparatus is configured to perform failure diagnosis of a power supply or a switching element for switching supply/shutting off of the power supply at the time of activation, in order to improve the safety of the apparatus. A field effect transistor (FET) is often used as the switching element, and thus in the following, a description is given based on the assumption that the switching element is the FET. In order to control supply of a power supply voltage to each portion inside the image forming apparatus, a plurality of FETs are installed in each power supply system for the portion. The image forming apparatus controls on/off of each FET to perform failure diagnosis for checking whether the power supply voltage is normally supplied to each power supply system. Specifically, the image forming apparatus performs failure diagnosis of an FET by determining whether the power supply voltage is supplied to an input terminal of the FET at the time of activation, a predetermined voltage is output to an output terminal of the FET in an on-state of the FET, or the power supply voltage supplied to the output terminal of the FET is shut off in an off-state of the FET. The image forming apparatus also monitors operation states of a power supply circuit and a load during operation, and performs failure diagnosis when an abnormality has occurred in any one of the operation states, to thereby identify a failure portion.

In general, the image forming apparatus uses two or more types of internal power supply voltages to drive an internal component. For example, a controller for controlling an operation of the image forming apparatus includes, for example, a microprocessor or an integrated circuit (IC) configured to execute signal processing, and requires a low voltage (e.g., 3.3 V) as the power supply voltage. A motor or the like configured to drive a photosensitive drum or a sheet feeding mechanism requires a higher voltage (e.g., 24 V) as the power supply voltage. The image forming apparatus constantly supplies a power supply voltage to the controller. However, in order to reduce standby power, the image forming apparatus shuts off the power supply voltage to be supplied to a component for forming an image, such as a photosensitive drum or a sheet feeding mechanism, in a standby state of the component.

In Japanese Patent Application Laid-open No. 2004-282893, there is disclosed a power supply apparatus configured to identify an abnormality occurrence portion and to optimally shut off power. This power supply apparatus includes, in a power supply circuit and a load, an operation detector configured to detect leakage of electricity, a voltage abnormality, a current abnormality, or a temperature abnormality, for example. The power supply apparatus executes abnormality determination processing when the operation detector has detected an abnormality. In the abnormality determination processing, supply of a voltage to the power supply apparatus, the power supply circuit, or the load is switched to identify a failure portion, which is a cause of occurrence of the abnormality.

In the image forming apparatus, when an abnormality, for example, paper jam, has occurred, a user removes a jammed sheet. At that time, supply of the power supply voltage to the component is shut off. To implement this function, the image forming apparatus includes an interlock switch configured to open and close in association with opening/closing of a front door to be opened at the time of removal of a sheet. Further, the image forming apparatus supplies the power supply voltage to each component for forming an image, such as a photosensitive drum or a sheet feeding mechanism, by another power supply system. The image forming apparatus includes an FET in each power supply system so that the power supply voltage can be shut off for the power supply system in a standby state. In such a configuration, when failure diagnosis is performed by controlling on/off of all the FETs at the time of activation in order to identify a failure, a period of time required for activation (activation period) becomes longer.

In view of the above, the present disclosure provides an image forming apparatus capable of performing failure diagnosis while at the same time reducing an activation period even in a configuration in which a plurality of switching elements are installed in a power system.

SUMMARY OF THE INVENTION

An image forming apparatus according to the present disclosure incudes a power supply board including a power supply circuit configured to generate a power supply voltage; a driver board including: a plurality of switching elements each configured to supply and shut off a power supply for each of a plurality of distributed power supply voltages supplied from the power supply board; and a driver circuit configured to drive a plurality of loads for forming an image by the plurality of distributed power supply voltages; and an engine control board configured to control an operation of the driver board, wherein the plurality of switching elements include: a first switching element, to which the power supply voltage is to be applied from the power supply board; and a second switching element, to which the power supply voltage output from the first switching element is to be applied in a distributed manner, and wherein the engine control board is configured to perform failure diagnosis of the first switching element when the image forming apparatus is activated, and perform failure diagnosis of the second switching element when an abnormality has occurred in any one of the plurality of loads.

Further features of the present invention will become apparent from the following description of exemplary embodiments (with reference to the attached drawings).

DESCRIPTION OF THE EMBODIMENTS

An image forming apparatus according to at least one embodiment of the present disclosure is described with reference to the drawings.

Image Forming Apparatus

Figure 1:
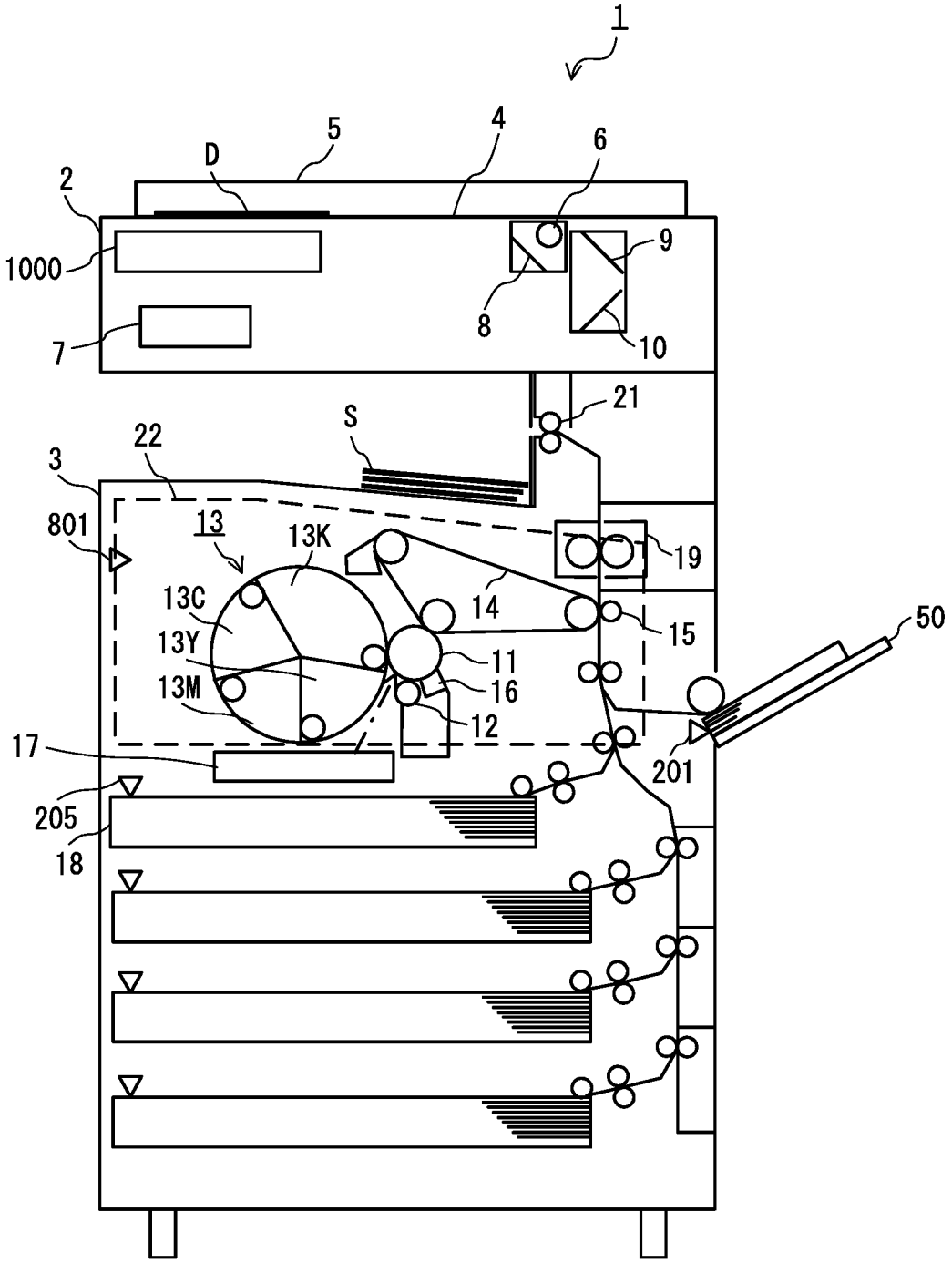
FIG. 1 is a configuration diagram of an image forming apparatus according to at least one embodiment of the present disclosure.

FIG. 1 is a configuration diagram of an image forming apparatus according to at least one embodiment of the present disclosure. The image forming apparatus 1 includes an image reader 2, an image forming unit 3, and an operation device 1000. The image reader 2 is configured to read an image from a document D. The image forming unit 3 is configured to form an image on a sheet S. The operation device 1000 is a user interface including an input device such as keys or a touch panel and an output device, for example, a display. The image forming apparatus 1 includes a copying function of forming the original image read by the image reader 2 on the sheet S by the image forming unit 3.

The image reader 2 includes, on its upper side, a original platen 4 formed of a transparent glass plate and a document pressing plate 5. The document D is placed at a predetermined position on the original platen 4 with an image side thereof facing downward. The document pressing plate 5 presses the document D placed on the original platen 4 in a fixed manner. A lamp 6 for irradiating the document D with light, an image processing unit 7, and an optical system including reflection mirrors 8, 9, and 10 for guiding light reflected from the irradiated document D to the image processing unit 7 are installed below the original platen 4. The lamp 6 and the reflection mirrors 8, 9, and 10 move at a predetermined speed to scan the document D. The image processing unit 7 generates image data representing a document image based on the light reflected from the irradiated document D.

In order to form an image, the image forming unit 3 includes components such as a photosensitive drum 11, a charging roller 12, a rotary developing unit 13, an intermediate transfer belt 14, a transfer roller 15, a cleaner 16, a laser unit 17, and a fixing device 19. The photosensitive drum 11 is a photosensitive member having a drum shape, and the surface of the photosensitive drum 11 is uniformly charged by the charging roller 12. The laser unit 17 acquires image data from the image reader 2, and irradiates the photosensitive drum 11 having the charged surface with laser light whose light emission is controlled in accordance with this image data. With this process, an electrostatic latent image that depends on the image data is formed on the surface of the photosensitive drum.

The rotary developing unit 13 causes toners of respective colors of magenta (M), cyan (C), yellow (Y), and black (K) to adhere to the electrostatic latent image formed on the surface of the photosensitive drum 11, to thereby form a toner image on the surface of the photosensitive drum 11. The rotary developing unit 13 is a developing device of a rotational development system. The rotary developing unit 13 includes a developing device 13K, a developing device 13Y, a developing device 13M, and a developing device 13C, and is rotated by a motor (rotary motor). The developing device 13K is configured to develop an image by toner of black. The developing device 13Y is configured to develop an image by toner of yellow. The developing device 13M is configured to develop an image by toner of magenta. The developing device 13C is configured to develop an image by toner of cyan.

When a monochrome toner image is to be formed on the photosensitive drum 11, the rotary developing unit 13 develops an image by causing the developing device 13K to rotationally move to a development position close to the photosensitive drum 11. When a full-color toner image is to be formed, the rotary developing unit 13 rotates to arrange the respective developing devices 13Y, 13M, 13C, and 13K at development positions in order, to thereby develop an image by toners of respective colors in order.

The toner image formed on the photosensitive drum 11 by the rotary developing unit 13 is transferred onto the intermediate transfer belt 14 which serves as a transfer member. Toners that remain on the photosensitive drum 11 after the transfer are cleaned by the cleaner 16. When a full-color toner image is to be formed, toner images of respective colors are transferred from the photosensitive drum 11 onto the intermediate transfer belt 14 in an overlapping manner one by one. That is, toner images are transferred onto the intermediate transfer belt 14 one by one in order of yellow, magenta, cyan, and black. The cleaner 16 removes toner remaining on the photosensitive drum 11 in each transfer. In this manner, toner images of respective colors are transferred one by one to form a full-color toner image on the intermediate transfer belt 14.

The toner image transferred onto the intermediate transfer belt 14 is transferred onto the sheet S by the transfer roller 15. The sheet S is supplied to the transfer roller 15 from a paper cassette 18 or a manual feed tray 50. The image forming apparatus 1 includes a feeding mechanism, for example, a roller, for supplying the sheet S to a conveyance path.

The fixing device 19 is installed on a downstream side of the transfer roller 15 with respect to a conveyance direction of the sheet S. The fixing device 19 fixes the transferred toner image onto the sheet S. The sheet S on which the toner image is fixed is delivered from the fixing device 19 to the outside of the image forming apparatus 1 via a discharge roller pair 21.

The image forming apparatus 1 includes a front door 22, which is openable and closable, in order to enable access to components such as the photosensitive drum 11 and the rotary developing unit 13 inside a casing of the image forming apparatus 1. The front door 22 is opened at the time of repair or inspection of each component described above inside the image forming apparatus 1 or at the time of replacement of consumables inside the image forming apparatus 1. The image forming apparatus 1 includes a front door opening/closing sensor 801 for detecting opening/closing of the front door 22.

The image forming apparatus 1 includes a paper cassette opening/closing sensor 205 for detecting opening/closing of each paper cassette 18, and a paper size detection sensor (not shown) configured to detect a size of the sheet S inside the paper cassette 18. When the paper cassette 18 is closed, the paper cassette opening/closing sensor 205 detects this closing. When the paper cassette opening/closing sensor 205 detects closing of the paper cassette 18, the paper size detection sensor automatically detects the size of the sheet S based on the result of the detection.

The image forming apparatus 1 includes a manual feed sensor 201 configured to detect whether there is a sheet S on the manual feed tray 50. When the manual feed sensor 201 has detected the fact that the sheet S is placed on the manual feed tray 50, the image forming apparatus 1 displays, on the operation device 1000, a screen for urging the user to set the size of the placed sheet S. The user sets the sheet size in accordance with the instruction on the screen, to thereby enable the image forming apparatus 1 to recognize the size of the sheet S on the manual feed tray 50.

The configuration of the image forming apparatus 1 is not limited to the above-mentioned configuration, and for example, an image forming apparatus having a well-known configuration in which a plurality of photosensitive drums are arranged along a movement direction of a transfer belt in association with a plurality of color components may be employed.

Control System

Figure 2:
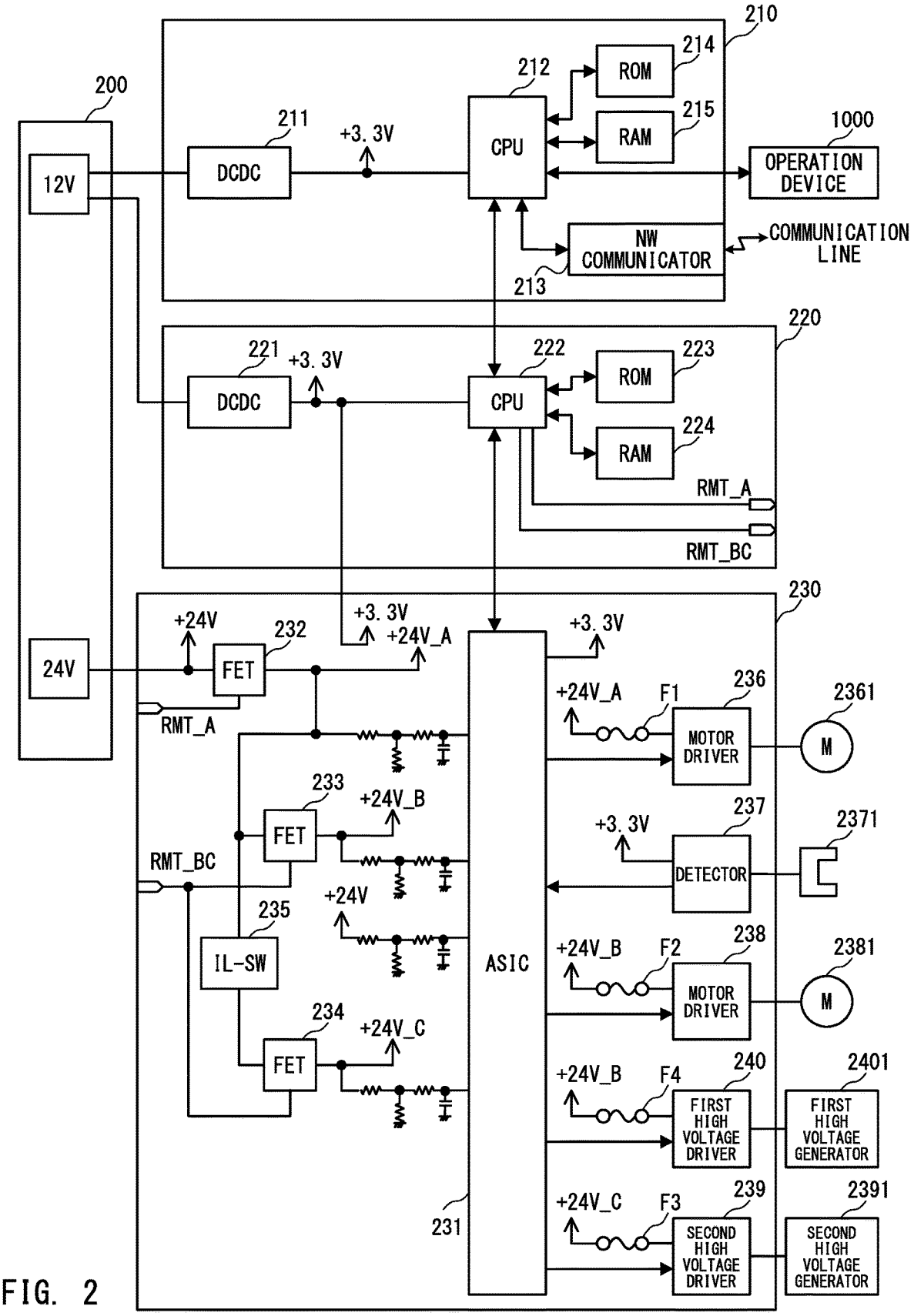
FIG. 2 is an explanatory diagram of a control system.

FIG. 2 is an explanatory diagram for illustrating a control system configured to control an operation of the image forming apparatus 1. The control system includes four types of boards, namely, a power supply board 200, a controller board 210, an engine control board 220, and a driver board 230.

The power supply board 200 generates two types of power supply voltages (+12 V and +24 V in this embodiment) from power supplied from an external commercial power supply, and outputs those types of power supply voltages. The power supply voltage of +12 V (hereinafter referred to as "+12V power supply voltage") is supplied to the controller board 210 and the engine control board 220. The power supply voltage of +24 V (hereinafter referred to as "+24V power supply voltage") is supplied to the driver board 230.

The controller board 210 includes a DC/DC converter 211, a central processing unit (CPU) 212, and a NW communicator 213. The DC/DC converter 211 converts the +12V power supply voltage supplied from the power supply board 200 into a voltage of +3.3 V. The voltage of +3.3 V generated by the DC/DC converter 211 is used for operations of internal and external components of the controller board 210 including the CPU 212. The CPU 212 is connected to a read only memory (ROM) 214 and a random access memory (RAM) 215. The CPU 212 executes a computer program stored in the ROM 214 to control an operation of the engine control board 220. At this time, the RAM 215 is used as a working memory. The NW communicator 213 is a communication interface for controlling communication to/from an external apparatus, for example, a call center, via a communication line, for example, a local area network (LAN). The CPU 212 performs communication to/from an external apparatus via the NW communicator 213. The CPU 212 is connected to the operation device 1000. The CPU 212 displays, for example, a message on the operation device 1000. Further, the CPU 212 receives input of, for example, an instruction from the operation device 1000.

The engine control board 220 includes a DC/DC converter 221, a CPU 222, a ROM 223, and a RAM 224. The DC/DC converter 221 converts the +12V power supply voltage supplied from the power supply board 200 into a voltage of +3.3 V. The voltage of +3.3 V generated by the DC/DC converter 211 is used for operations of the CPU 222 and the driver board 230. The CPU 222 executes a computer program stored in the ROM 223 to control an operation of each component and execute various kinds of control sequences relating to image formation. At this time, the RAM 224 is used as a working memory, and stores rewritable data required to be stored temporally or permanently. The CPU 222 controls an operation of the driver board 230. The RAM 224 stores information on an abnormality at the time of occurrence of the abnormality.

The driver board 230 distributes the +24V power supply voltage supplied from the power supply board 200 into a plurality of power supply systems (three in this embodiment). The driver board 230 includes FETs 232, 233, and 234. The driver board 230 includes an application specific integrated circuit (ASIC) 231 configured to control a load. Further, the driver board 230 includes motor drivers 236 and 238, a detector 237, a first high voltage driver 240, a second high voltage driver 239, and fuses F1 to F4.

The FETs 232, 233, and 234 are switching elements, and switch supply/shutting off of the +24V power supply voltage supplied from the power supply board 200 to each power supply system. The FETs 232, 233, and 234 are constructed at multiple stages, and from the power supply board 200, the FET 232 is installed at the first stage, and the FETs 233 and 234 are installed at the subsequent stage. Through combination of the FETs 232, 233, and 234, a plurality of power supply voltages are generated from the +24V power supply voltage.

Specifically, in a conductive state, the +24V power supply voltage is applied to the FET 232 to output a +24V_A voltage serving as the power supply voltage. In a conductive state, the +24V_A voltage is applied to the FET 233 to output a +24V_B voltage serving as the power supply voltage. In a conductive state, the +24V_A voltage is applied to the FET 234 to output a +24V_C voltage serving as the power supply voltage. An interlock switch (IL-SW) 235 is installed between the FET 232 and the FET 234. The IL-SW 235 immediately shuts off supply of the +24V_A voltage from the FET 232 to the FET 234 when the front door 22 installed in the image forming apparatus 1 is opened.

The +24V power supply voltage is divided so as to fall within a rated range of the ASIC 231 so that it can be determined whether a voltage is normally supplied from the power supply board 200. The divided +24V power supply voltage is input to an analog port of the ASIC 231 as a +24V power supply detection signal. The +24V_A voltage is divided so as to fall within a rated range of the ASIC 231 so that it can be determined whether the +24V_A voltage is normally output from the FET 232. The divided +24V_A voltage is input to an analog port of the ASIC 231 as a +24V_A power supply detection signal. The +24V_B voltage is divided so as to fall within the rated range of the ASIC 231 so that it can be determined whether the +24V_B voltage is normally output from the FET 233. The divided +24V_B voltage is input to an analog port of the ASIC 231 as a +24V_B power supply detection signal. The +24V_C voltage is divided so as to fall within the rated range of the ASIC 231 so that it can be determined whether the +24V_C voltage is normally output from the FET 234. The divided +24V_C voltage is input to an analog port of the ASIC 231 as a +24V_C power supply detection signal. A configuration for determining whether the +24V power supply voltage is normally supplied is not limited to the above-mentioned configuration. For example, the +24V power supply voltage may be converted into a digital value by a detection circuit, for example, a transistor, and input to a digital port of the ASIC 231.

As described above, the first high voltage driver 240, the second high voltage driver 239, and a predetermined number of motor drivers 236 and 238 are implemented on the driver board 230. The motor drivers 236 and 238 are used for driving a motor for rotating the rotary developing unit 13, a motor to be used for delivery of a sheet, or the like. The first high voltage driver 240 drives a first high voltage generator 2401 configured to generate a high voltage for forming an electrostatic latent image. The second high voltage driver 239 drives a second high voltage generator 2391 configured to generate a high voltage for transferring a toner image on the intermediate transfer belt 14 onto the sheet S.

The +24V_A voltage is supplied via the fuse F1 to the motor driver 236 for driving a fixing motor 2361 configured to rotate a fixing roller pair of the fixing device 19. The +24V_B voltage is supplied via the fuse F2 to the motor driver 238 for driving a polygon motor 2381, which is a load installed inside the laser unit 17. Further, the +24V_B voltage is supplied to the first high voltage driver 240 via the fuse F4. The +24V_C voltage is supplied to the second high voltage driver 239 via the fuse F3. In the image forming apparatus 1, a high voltage generator configured to generate a high voltage for developing an electrostatic latent image by toner, a driver for driving the high voltage generator, a plurality of motors other than the above-mentioned motors, and drivers for driving the plurality of motors are installed in the image forming apparatus 1. However, those components are omitted in FIG. 2.

The fuses F1 to F4 are protection elements installed to protect, when an abnormality has occurred in a power supply system of the +24V power supply voltage due to a load connected to the driver board 230, the power supply system so as to prevent the abnormality from spreading to the upstream power supply board 200. In addition, a predetermined number of detectors for acquiring results of the detection by a sensor for detecting a sheet size and a sensor for detecting presence of a sheet described with reference to FIG. 1 are implemented on the driver board 230. In the example of FIG. 2, the driver board 230 is capable of acquiring a result of the detection by a rotation detection sensor 2371 via the detector 237. The rotation detection sensor 2371 detects rotation of a polygon mirror (not shown) incorporated in the laser unit 17. The polygon mirror is rotationally driven by the polygon motor 2381.

The CPU 222 of the engine control board 220 controls on/off of each of the FETs 232, 233, and 234 of the driver board 230. An RMT_A signal transmitted from the CPU 222 controls on/off of the FET 232. The RMT_A signal turns on the FET 232 to output the +24V_A voltage, or turns off the FET 232 to shut off output of the +24V_A voltage. An RMT_BC signal transmitted from the CPU 222 or a main power supply switch (not shown) controls on/off of the FETs 233 and 234. The FET 233 is turned on by the RMT_BC signal or the main power supply switch to output the +24V_B voltage, or is turned off to shut off output of the +24V_B voltage. The FET 234 is turned on by the RMT_BC signal or the main power supply switch to output the +24V_C voltage, or is turned off to shut off output of the +24V_C voltage.

There are two reasons why the +24V power supply voltage is distributed to three power supply systems. One of the reasons is to suppress power consumption by shutting off supply of the power supply voltage to an unrequired load depending on an operation state of the image forming apparatus 1. The other reason is to cause each load to perform an operation depending on its characteristic when the power supply is shut off at the time of an off state of the power supply or occurrence of an abnormality.

For example, the fixing motor 2361, which is operated by the +24V_A voltage, is used for rotationally driving a fixing roller pair in positive rotation. However, the fixing motor 2361 is used for controlling the fixing roller pair to be in contact or separated in reverse rotation. When the fixing roller pair is left as it is while the rollers thereof are in contact for a long period of time, the fixing roller pair may deform to cause a streak on the image. In view of this, the motor driver 236 does not stop its operation immediately at the time of turning off of the power supply, and is stopped after the fixing roller pair has been separated by a separation operation.

Loads operated by the +24V_B voltage and the +24V_C voltage stops their operations immediately at the time of turning off of the power supply. The polygon motor 2381 operated by the +24V_B voltage is required to stop its operation immediately by an operation of the main power supply switch when the polygon motor 2381 does not stop due to a control abnormality, for example. Thus, supply of the +24V_B voltage to the polygon motor 2381 is immediately stopped at the time of turning off of the power supply. Similarly, the first high voltage generator 2401 operated by the +24V_B voltage is required to stop its output immediately by an operation of the main power supply switch at the time of occurrence of a control abnormality, for example. Thus, supply of the +24V_B voltage to the first high voltage generator 2401 is immediately shut off at the time of turning off of the power supply. Supply of the +24V_C voltage to the second high voltage driver 239 configured to drive the second high voltage generator 2391 operated by the +24V_C voltage is immediately shut off by the IL-SW 235 through opening of the front door 22 at the time of removal of the sheet S due to a paper jam, for example.

The ASIC 231 controls drive of the fixing motor 2361 by controlling the motor driver 236. The ASIC 231 controls drive of the polygon motor 2381 by controlling the motor driver 238. Rotation of the polygon mirror, which is rotationally driven by the polygon motor 2381, is detected by the rotation detection sensor 2371. The ASIC 231 acquires a result of the detection by the rotation detection sensor 2371 via the detector 237. The ASIC 231 controls drive of the second high voltage generator 2391 by controlling the second high voltage driver 239. With this, output of a high voltage for transferring a toner image by the second high voltage generator 2391 is controlled.

The ASIC 231 controls a timing to drive each load by receiving an instruction from the CPU 222 of the engine control board 220. The CPU 222 of the engine control board 220 monitors a state of a signal acquired by the ASIC 231. The CPU 222 of the engine control board 220 communicates to/from the CPU 212 of the controller board 210 to control an operation of the control system in cooperation with the CPU 212.

When the CPU 212 of the controller board 210 has received an instruction to start formation of an image by a user via the operation device 1000 or a communication line, the CPU 212 notifies the CPU 222 of the engine control board 220 of the fact that the instruction to start formation of an image is received. The CPU 222 of the engine control board 220, which has received the instruction to start formation of an image, controls an operation of the driver board 230 to form an image on the sheet S.

The CPU 222 of the engine control board 220 stores into the RAM 224 information on an abnormality detected by the driver board 230. Further, the CPU 222 notifies the CPU 212 of the controller board 210 of occurrence of an abnormality. When the CPU 212 of the controller board 210 is notified of occurrence of an abnormality, the CPU 212 notifies a user or a service engineer of occurrence of the abnormality by, for example, the operation device 1000. Further, the CPU 212 notifies a call center of occurrence of an abnormality via a communication line by the NW communicator 213. In this manner, in addition to the user or the service engineer in a location at which the image forming apparatus 1 is installed, a service engineer in the call center is notified of occurrence of an abnormality.

Image Forming Processing

Figure 3:
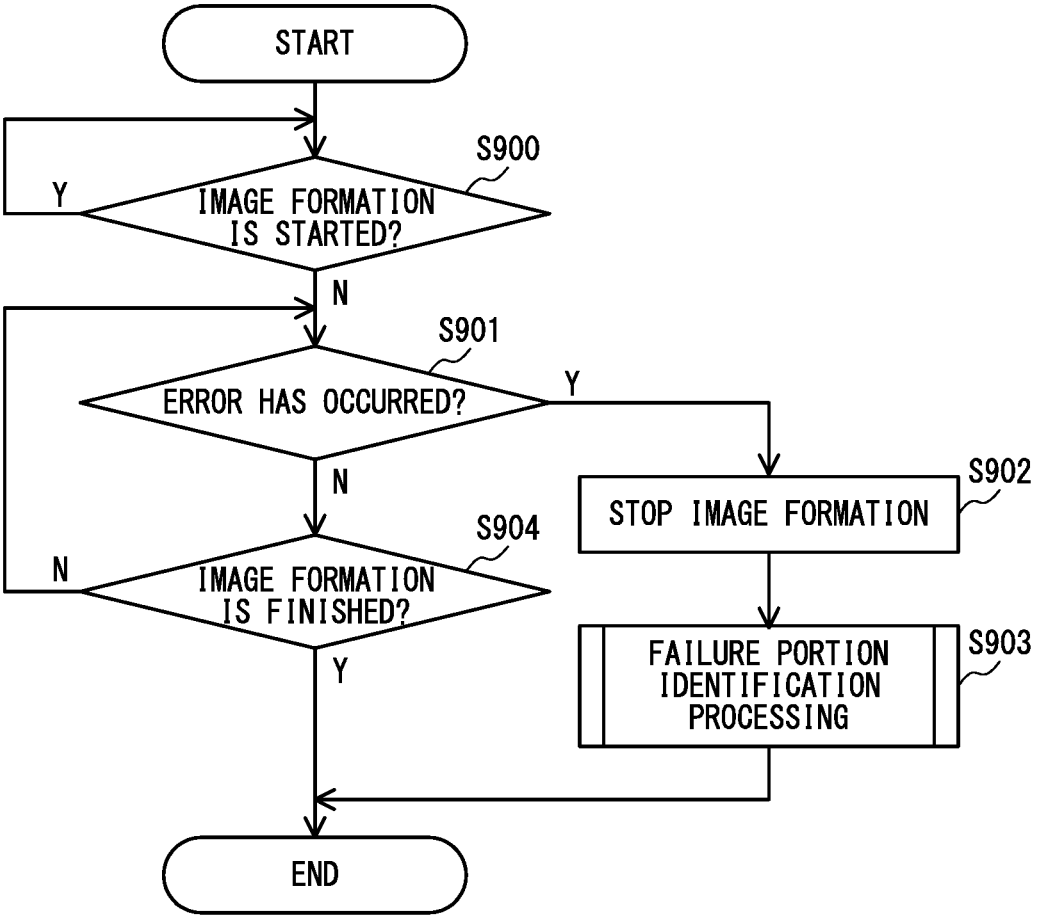
FIG. 3 is a flow chart for illustrating image forming processing.

FIG. 3 is a flow chart for illustrating processing (image forming processing) to be executed at the time of image formation by the image forming apparatus 1. The CPU 212 of the controller board 210 is in a standby state until an instruction to start formation of an image is acquired via the operation device 1000 or the communication line (Step S900: N). When an instruction to start image formation is received (Step S900: Y), the CPU 212 instructs the CPU 222 of the engine control board 220 to execute an image forming operation. The CPU 222 of the engine control board 220 starts an image forming operation in response to this instruction. The ASIC 231 of the driver board 230 monitors occurrence of an error due to an abnormality of each component until the image forming operation is finished (Step S901: N, and Step S904: N). In this case, the ASIC 231 monitors occurrence of an error of a load based on results of detection by various kinds of sensors installed in the image forming apparatus 1. When the image forming operation is finished (Step S904: Y), the CPU 212 finishes the image forming processing illustrated in FIG. 3.

When an error has occurred in operation of a load during an image forming operation (Step S901: Y), the ASIC 231 notifies the CPU 222 of the engine control board 220 of occurrence of an abnormality. In this embodiment, after control of rotating the polygon motor 2381 is started and a predetermined period of time has elapsed, when the rotation detection sensor 2371 has not detected rotation of the polygon mirror, occurrence of an abnormality (error) is detected. When the CPU 222 of the engine control board 220 has acquired a notification of occurrence of an abnormality from the ASIC 231, the CPU 222 stops the image forming operation (Step S902). The CPU 222 of the engine control board 220 executes processing of identifying a failure portion, which is a cause of the abnormality (Step S903). When the processing of identifying a failure portion is finished, the CPU 212 finishes the image forming processing. In addition, the processing of identifying a failure portion may be executed due to occurrence of an abnormality at the time of a pre-multiple rotation operation (preparation operation) of activation of the image forming apparatus 1, for example. However, a description of the processing is omitted here.

Failure Identification Processing

Figure 4:
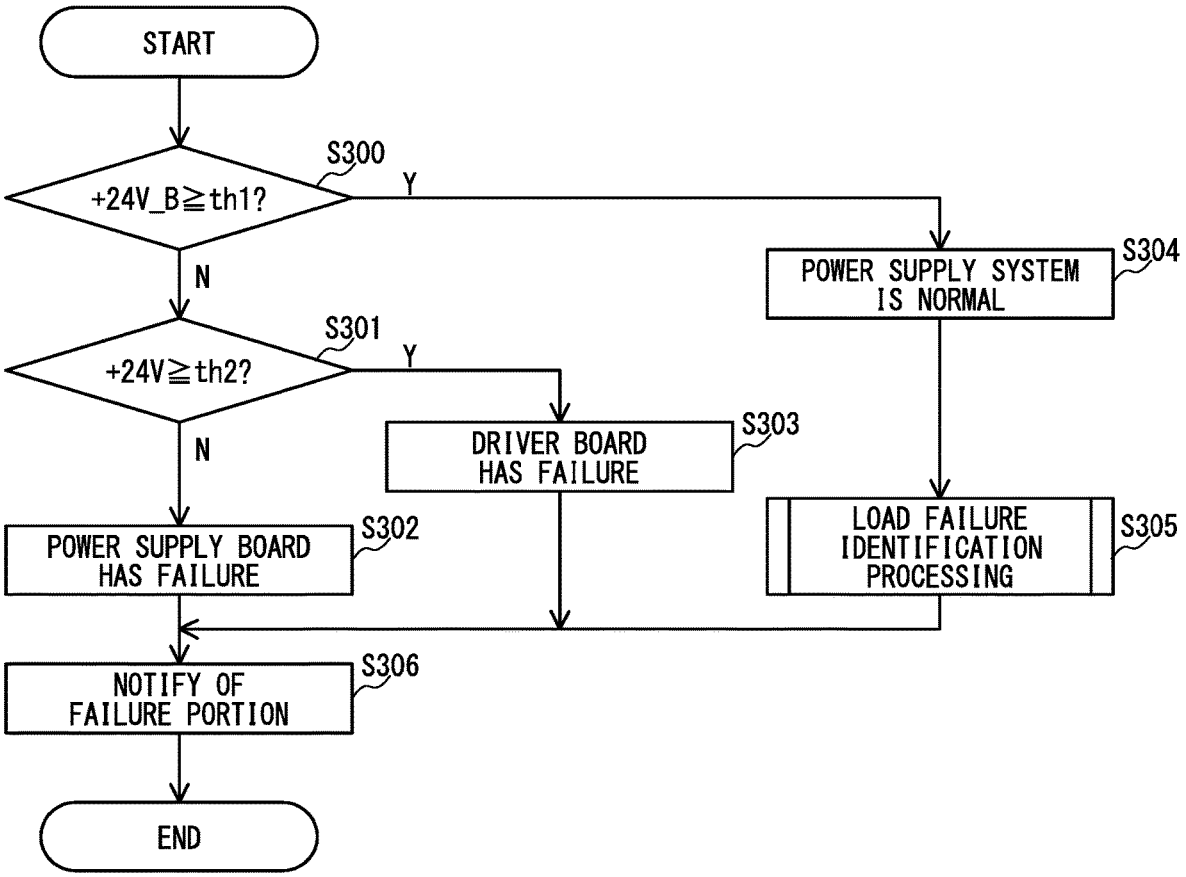
FIG. 4 is a flow chart for illustrating processing of identifying a failure portion.

FIG. 4 is a flow chart for illustrating the processing of identifying a failure portion in Step S903 of FIG. 3. This processing represents processing of identifying a failure portion in a case where an abnormality has occurred in operation of a load to which the +24V_B voltage is supplied. This processing is processing of determining whether an abnormality has occurred in a power supply system of the +24V power supply voltage when an abnormality is detected in operation of a load, and identifying, when there is an abnormality, a failure portion which is a cause of the abnormality. In this embodiment, a description is given of a case of executing this processing in response to an abnormality (error) in operation of the polygon motor 2381 which serves as a load.

The CPU 222 of the engine control board 220 uses the ASIC 231 of the driver board 230 to compare a voltage value of the +24V_B voltage with a predetermined first threshold value th1 (Step S300). In this case, the first threshold value th1 is set to be 18 V. When the voltage value of the +24V_B voltage is equal to or larger than the first threshold value th1 (Step S300: Y), the CPU 222 determines that the power supply system of the +24V power supply voltage is normal (Step S304). In this case, the CPU 222 determines that the load, which is operated by the power supply system connected to the same, is a cause of the abnormality, and executes load failure identification processing of identifying a load that has failed (Step S305). A detailed description of the load failure identification processing is omitted.

When the voltage value of the +24V_B voltage is smaller than the first threshold value th1 (Step S300: N), the CPU 222 determines that the power supply system of the +24V power supply voltage is a cause of the failure. The CPU 222 compares the voltage value of the +24V power supply voltage with a predetermined second threshold value th2 by using the ASIC 231 (Step S301). In this case, the second threshold value th2 is set to be 18 V, which is the same as the first threshold value th1.

When the voltage value of the +24V power supply voltage is equal to or larger than the second threshold value th2 (Step S301: Y), the CPU 222 determines that the +24V power supply voltage is normally supplied from the power supply board 200. With this, the CPU 222 determines that the +24V_B voltage output from the FET 233 implemented on the driver board 230 is a cause of the abnormality in the power supply system of the +24V power supply voltage. Thus, the CPU 222 determines that the driver board 230 is a failure portion, which is a cause of the abnormality (Step S303).

When the voltage value of the +24V power supply voltage is smaller than the second threshold value th2 (Step S301: N), the CPU 222 determines that the +24V power supply voltage is not normally supplied from the power supply board 200. With this, the CPU 222 determines that the +24V power supply voltage output from the power supply board 200 is a cause of the abnormality in the power supply system of the +24V power supply voltage. Thus, the CPU 222 determines that the power supply board 200 is a failure portion, which is a cause of the abnormality (Step S302).

Figure 5:
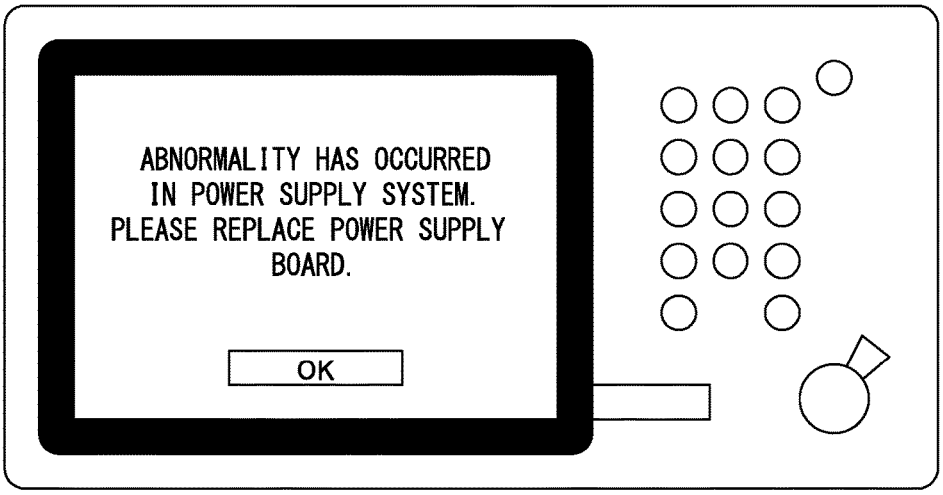
FIG. 5 is a diagram for illustrating an exemplary failure portion to be displayed on an operation device.

The CPU 222 notifies the CPU 212 of the controller board 210 of the failure portion determined by the processing of any one of Step S302, Step S303, and Step S305. The CPU 212 notifies of the failure portion in response to the notification (Step S306). The CPU 212 gives a notification by displaying the failure portion on the operation device 1000, for example. FIG. 5 is a diagram for illustrating an exemplary failure portion to be displayed on the operation device 1000. FIG. 5 represents an example of display in a case where the power supply board 200 has failed, which displays a message urging replacement of the power supply board 200. Further, the CPU 212 notifies a support center of the failure portion via a communication line by the NW communicator 213. The processing of identifying the failure portion is finished through the notification of the failure portion.

In the above-mentioned processing, the relationship between the first threshold value th1 and the second threshold value th2 is as described below. In the case of "th1<th2", for example, when the range of the power supply voltage (+24V power supply voltage) supplied from the power supply board 200 is between the first threshold value th1 and the second threshold value th2, the +24V power supply voltage is smaller than the second threshold value th2 in the processing of Step S301. Thus, supply of the power supply to the power supply board 200 is determined to be a cause of the abnormality. However, the +24V_B voltage may be determined to be equal to or larger than the first threshold value th1 in the processing of Step S300 executed before, resulting in erroneous diagnosis that the power supply system is normal. Thus, in the relationship between the first threshold value th1 and the second threshold value th2, the first threshold value th1 is preferred to be equal to or larger than the second threshold value th2 (th2≤th1). Further, in the configuration of FIG. 2, it is preferred to design the relationship between the first threshold value th1 and the second threshold value th2 so as to satisfy the above-mentioned relationship also when a detection circuit, for example, a transistor, detects the state of the power supply.

Failure Identification Processing for FET

Figure 6:
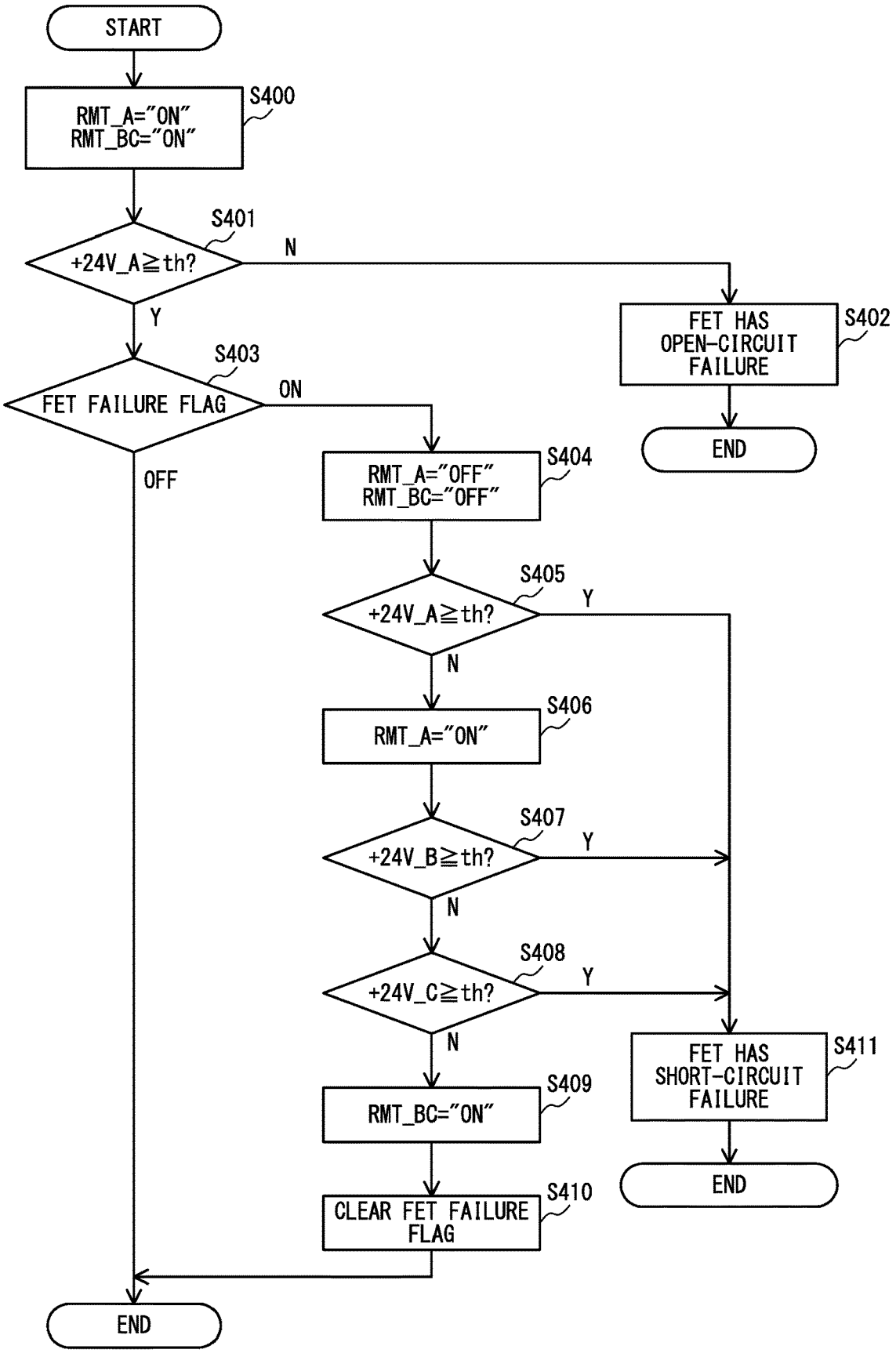
FIG. 6 is a flow chart for illustrating failure identification processing for an FET.
Figure 7:
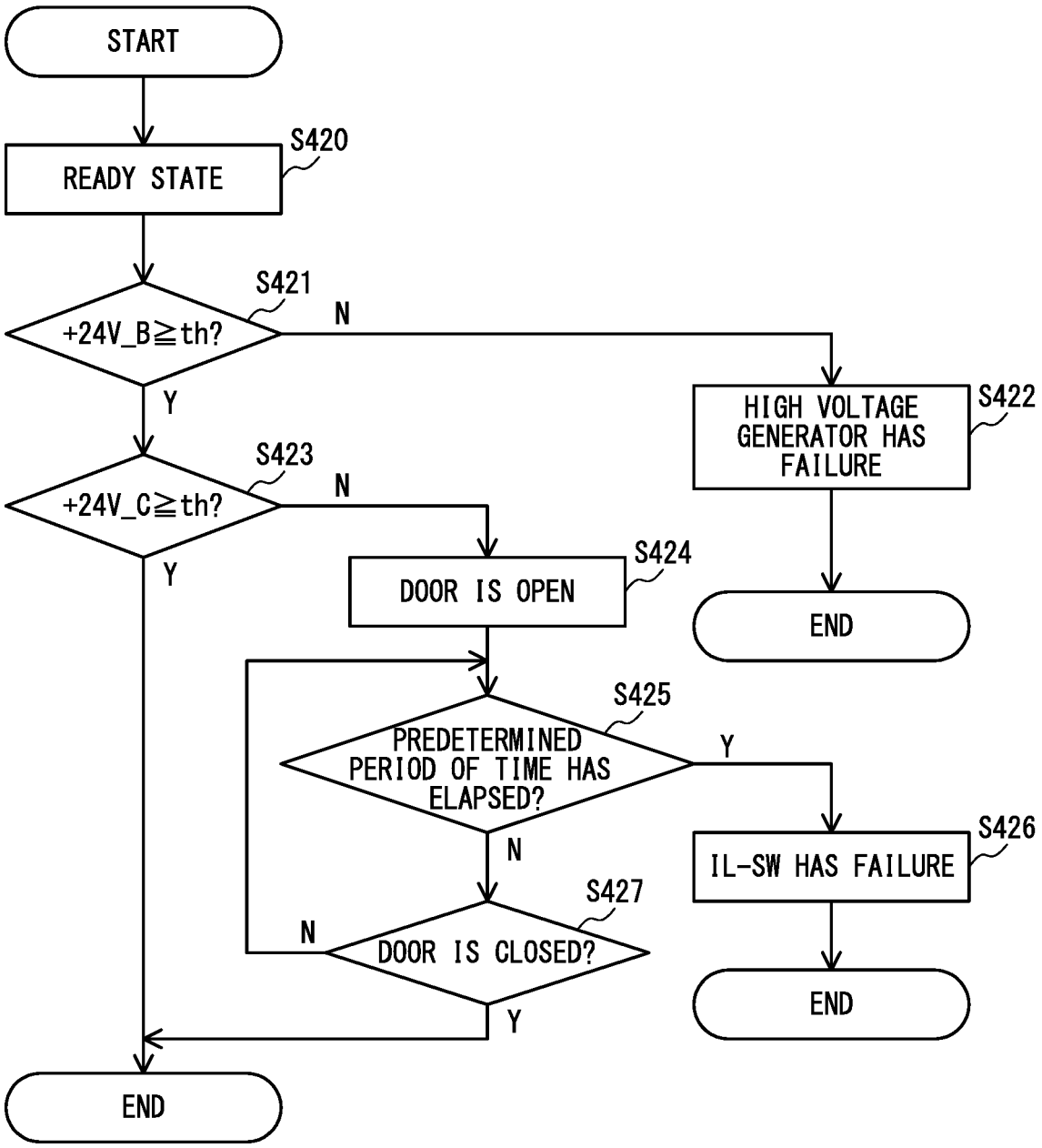
FIG. 7 is a flow chart for illustrating the failure identification processing for the FET.
Figure 8:
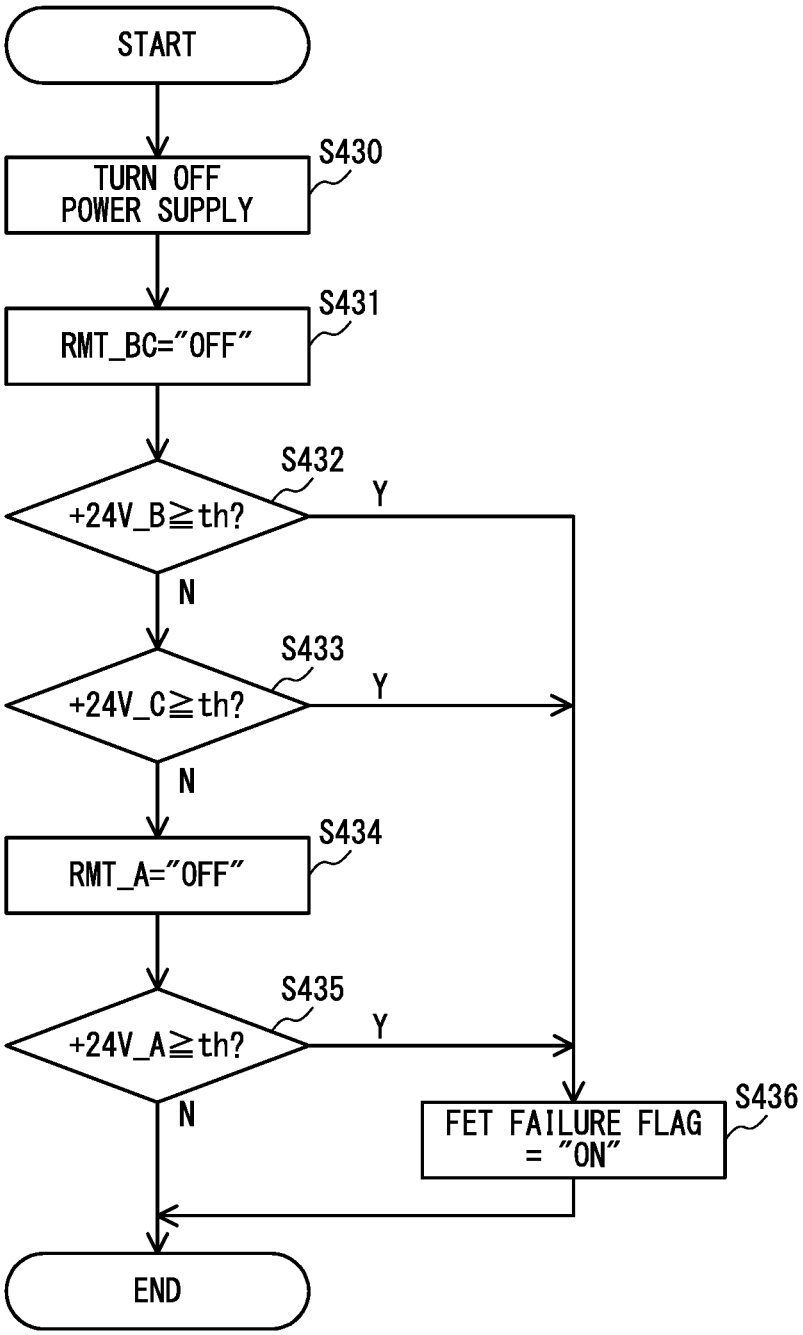
FIG. 8 is a flow chart for illustrating the failure identification processing for the FET.

FIG. 6, FIG. 7, and FIG. 8 are flow charts for illustrating failure identification processing for the FETs 232, 233, and 234 of the driver board 230. This processing is executed to ensure safety of an apparatus in each state of "power supply on" (activation), "during operation", and "power supply off" (stop) of the image forming apparatus 1.

FIG. 6 represents processing to be executed at the time of turning on of the power supply of the image forming apparatus. This processing is executed by operating the main power supply switch and turning on the power supply of the image forming apparatus 1.

When the power supply of the image forming apparatus 1 is turned on, the CPU 222 of the engine control board 220 outputs an RMT_A signal and an RMT_BC signal for turning on each of the FETs 232, 233, and 234 (conductive state) (Step S400). After the CPU 222 has waited for a predetermined period of time (e.g., waited for 300 milliseconds) to switch the FETs 232, 233, and 234, the CPU 222 uses the ASIC 231 to determine whether the +24V_A voltage is output from the FET 232 (Step S401). The ASIC 231 determines whether the +24V_A voltage is output by determining whether the voltage value of the +24V_A voltage is equal to or larger than a predetermined threshold voltage th. When the +24V_A voltage is not output (Step S401: N), the +24V_A voltage is not output in spite of the fact that the FET 232 is controlled to be on, and thus the CPU 222 determines that the FET 232 has an open-circuit failure, and finishes the processing (Step S402).

When the +24V_A voltage is output (Step S401: Y), the CPU 222 checks an FET failure flag (Step S403). The FET failure flag is stored in the RAM 224 of the engine control board 220, and is referred to by the CPU 222. The FET failure flag is information indicating whether any one of the FETs 232, 233, and 234 has failed, and when any one of the FETs 232, 233, and 234 has failed, the FET failure flag becomes an on state. The failure flag may be set individually for each FET. The FET failure flag is desired to be set to be on (failure state of FET) as an initial value at the time of shipment from a factory in order to improve the safety of the apparatus. After the image forming apparatus 1 is activated for the first time, when a failure is not detected, the FET failure flag is set to be off. When the FET failure flag is off (Step S403: OFF), the CPU 222 executes processing of activating the image forming apparatus 1. With this, the image forming apparatus 1 can be activated at high speed in response to an operation of the main power supply switch.

When the FET failure flag is on (Step S403: ON), the CPU 222 outputs an RMT_A signal and an RMT_BC signal for turning off each of the FETs 232, 233, and 234 (shut-off state) (Step S404). After the CPU 222 has waited for a predetermined period of time (e.g., waited for 500 milliseconds) to switch the FETs 232, 233, and 234, the CPU 222 uses the ASIC 231 to determine whether the +24V_A voltage is output from the FET 232 (Step S405). The ASIC 231 determines whether the +24V_A voltage is output by determining whether the voltage value of the +24V_A voltage is equal to or larger than the predetermined threshold voltage th. When the +24V_A voltage is output (Step S405: Y), the +24V_A voltage is output in spite of the fact that the FET 232 is controlled to be off, and thus the CPU 222 determines that the FET 232 has a short-circuit failure, and finishes the processing (Step S411).

When the +24V_A voltage is not output (Step S405: N), the CPU 222 determines that the FET 232 is normally operating. In this case, the CPU 222 outputs an RMT_A signal for turning on the FET 232 provided at the previous stage of the FETs 233 and 234 (Step S406). With this, the +24V_A voltage is supplied from the FET 232 to the FETs 233 and 234. After the CPU 222 has waited for a predetermined period of time (e.g., waited for 300 milliseconds) to switch the FET 232, the CPU 222 uses the ASIC 231 to determine whether the +24V_B voltage is output from the FET 233 (Step S407). The ASIC 231 determines whether the +24V_B voltage is output by determining whether the voltage value of the +24V_B voltage is equal to or larger than the predetermined threshold voltage th. When the +24V_B voltage is output (Step S407: Y), the +24V_B voltage is output in spite of the fact that the FET 233 is controlled to be off, and thus the CPU 222 determines that the FET 233 has the short-circuit failure, and finishes the processing (Step S411).

When the +24V_B voltage is not output (Step S407: Y), the CPU 222 determines that the FET 233 is normally operating. In this case, the CPU 222 uses the ASIC 231 to determine whether the +24V_C voltage is output from the FET 234 (Step S408). The ASIC 231 determines whether the +24V_C voltage is output by determining whether the voltage value of the +24V_C voltage is equal to or larger than the predetermined threshold voltage th. When the +24V_C voltage is output (Step S408: Y), the +24V_C voltage is output in spite of the fact that the FET 234 is controlled to be off, and thus the CPU 222 determines that the FET 234 has the short-circuit failure, and finishes the processing (Step S411).

When the +24V_C voltage is not output (Step S408: N), the CPU 222 determines that the FET 234 is normally operating. In this case, the CPU 222 outputs an RMT_BC signal for turning on the FETs 233 and 234 provided at the subsequent stage of the FET 232 (Step S409). With this, all the FETs 232, 233, and 234 are turned on, and the +24V_A voltage, the +24V_B voltage, and the +24V_C voltage start to be supplied to corresponding loads via respective power supply systems. After the CPU 222 has waited for a predetermined period of time (e.g., waited for 300 milliseconds) to switch the FETs 233 and 234, the CPU 222 clears the FET failure flag (Step S410). That is, the CPU 222 rewrites data of the FET failure flag stored in the RAM 224 so that the FET failure flag is set to be off. The CPU 222 executes processing of activating the image forming apparatus 1 after the FET failure flag is rewritten.

In the above-mentioned processing at the time of activation, when the CPU 222 determines that the FET has failed in the processing of Step S402 and the processing of Step S411, the CPU 222 notifies of a failure portion similarly to Step S306 of FIG. 4. With this, the FET that has failed is notified to the user or the support center. The image forming apparatus 1 detects a failure even when the main power supply switch is turned on/off until the FET that has failed is replaced (driver board 230 is replaced). When the FET that has failed is replaced, the image forming apparatus 1 executes the processing of Step S400 and subsequent processing again, whereas when there is no failure in the FET, the image forming apparatus 1 executes activation processing.

FIG. 7 represents processing during operation of the image forming apparatus 1. This processing is executed when the driver board 230 is determined to have failed in the processing of identifying the failure portion of FIG. 4 (Step S303). The FETs 232, 233, and 234 are all on.

When the image forming apparatus 1 finishes the activation processing and image formation is ready (ready state) (Step S420), determination of a failure of the driver board 230 causes the CPU 222 of the engine control board 220 to start this processing. The CPU 222 uses the ASIC 231 to determine whether the +24V_B voltage is output from the FET 233 (Step S421). The ASIC 231 determines whether the +24V_B voltage is output by determining whether the voltage value of the +24V_B voltage is equal to or larger than the predetermined threshold voltage th. When the +24V_B voltage is not output (Step S421: N), the +24V_B voltage is not output in spite of the fact that the FET 233 is controlled to be on, and thus the CPU 222 determines that the FET 233 has an open-circuit failure. In this case, the CPU 222 determines that an error has occurred in the first high voltage generator 2401, which is driven by the first high voltage driver 240 and configured to generate a high voltage for forming an electrostatic latent image (Step S422). Similarly to Step S306 of FIG. 4, the CPU 222 notifies of a failure of the first high voltage generator 2401. With this, the user or the support center is notified of the fact that the first high voltage generator 2401 has failed. The service engineer replaces the board of the first high voltage generator 2401 in response to this notification.

When the +24V_B voltage is output (Step S421: N), the CPU 222 uses the ASIC 231 to determine whether the +24V_C voltage is output from the FET 234 (Step S423). The ASIC 231 determines whether the +24V_C voltage is output by determining whether the voltage value of the +24V_C voltage is equal to or larger than the predetermined threshold voltage th. When the +24V_C voltage is output (Step S423: Y), the CPU 222 determines that the power supply systems of the FETs 233 and 234 are normal, and finishes this processing.

When the +24V_C voltage is not output (Step S423: N), the CPU 222 determines that the front door 22 is open (Step S424). This is because the +24V_C voltage is not output after confirmation of the fact that the FET 234 is normally operating in processing at the time of activation, and thus it is estimated that the +24V_A voltage is not supplied to the FET 234. When it is determined that the front door 22 is open, the CPU 222 displays, on the operation device 1000, an instruction to close the front door 22 by the CPU 212 of the controller board 210. Opening/closing of the front door 22 is detected by the front door opening/closing sensor 801. The CPU 222 checks whether the front door 22 remains to be open after elapse of a predetermined period of time (10 minutes in this embodiment) based on a result of the detection by the front door opening/closing sensor 801 (Step S425 and Step S427). When the front door 22 is closed before elapse of the predetermined period of time (Step S425: N; Step S427: Y), the CPU 222 finishes this processing.

When the front door 22 remains to be open after elapse of the predetermined period of time (Step S425: Y), the CPU 222 determines that the IL-SW 235 has failed (Step S426). Further, at this time, the +24V_C voltage is not output in spite of the fact that the FET 234 is controlled to be on, and thus the CPU 222 determines that the FET 234 has an open-circuit failure. Similarly to Step S306 of FIG. 4, the CPU 222 notifies of a failure of the IL-SW 235. With this, the user or the support center is notified of the fact that the IL-SW 235 has failed. The service engineer replaces the board of the IL-SW 235 in response to this notification.

FIG. 8 represents processing to be executed at the time of turning off of the power supply of the image forming apparatus 1. This processing is executed by the user operating the main power supply switch and turning off the power supply, or when, for example, an instruction to form an image is not input for a predetermined period of time and the mode transitions to a sleep mode (power saving mode).

When the power supply is turned off or the mode transitions to the sleep mode, the CPU 222 of the engine control board 220 outputs an RMT_BC signal for turning off the FETs 233 and 234 at the subsequent stage of the FET 232 (Step S430 and Step S431). After the CPU 222 has waited for a predetermined period of time (e.g., waited for 300 milliseconds) to switch the FETs 233 and 234, the CPU 222 uses the ASIC 231 to determine whether the +24V_B voltage is output from the FET 233 (Step S432). The ASIC 231 determines whether the +24V_B voltage is output by determining whether the voltage value of the +24V_B voltage is equal to or larger than the predetermined threshold voltage th.

When the +24V_B voltage is output (Step S432: Y), the +24V_B voltage is output in spite of the fact that the FET 233 is controlled to be off, and thus the CPU 222 determines that the FET 233 has the short-circuit failure. In this case, the CPU 222 sets the FET failure flag to be on (Step S436). That is, the CPU 222 rewrites the FET failure flag stored in the RAM 224 so that the FET failure flag is set to be on, which indicates occurrence of a failure. After rewriting the FET failure flag, the CPU 222 executes finish processing or sleep transition processing for the image forming apparatus 1.

When the +24V_B voltage is not output (Step S432: N), the CPU 222 uses the ASIC 231 to determine whether the +24V_C voltage is output from the FET 234 (Step S433). The ASIC 231 determines whether the +24V_C voltage is output by determining whether the voltage value of the +24V_C voltage is equal to or larger than the predetermined threshold voltage th. When the +24V_C voltage is output (Step S433: Y), the +24V_C voltage is output in spite of the fact that the FET 234 is controlled to be off, and thus the CPU 222 determines that the FET 234 has the short-circuit failure. In this case, the CPU 222 sets the FET failure flag to be on (Step S436). That is, the CPU 222 rewrites the FET failure flag stored in the RAM 224 so that the FET failure flag is set to be on, which indicates occurrence of a failure. After rewriting the FET failure flag, the CPU 222 executes finish processing or sleep transition processing for the image forming apparatus 1.

When the +24V_C voltage is not output (Step S433: N), the CPU 222 outputs an RMT_A signal for turning off the FET 232 at the previous stage of the FETs 233 and 234 (Step S434). With this, supply of the +24V_A voltage from the FET 232 to the FETs 233 and 234 is shut off. After the CPU 222 has waited for a predetermined period of time (e.g., waited for 500 milliseconds) to switch the FET 232, the CPU 222 uses the ASIC 231 to determine whether the +24V_A voltage is output from the FET 232 (Step S435). The ASIC 231 determines whether the +24V_A voltage is output by determining whether the voltage value of the +24V_A voltage is equal to or larger than the predetermined threshold voltage th.

When the +24V_A voltage is output (Step S435: Y), the +24V_A voltage is output in spite of the fact that the FET 232 is controlled to be off, and thus the CPU 222 determines that the FET 232 has the short-circuit failure. In this case, the CPU 222 sets the FET failure flag to be on (Step S436). That is, the CPU 222 rewrites the FET failure flag stored in the RAM 224 so that the FET failure flag is set to be on, which indicates occurrence of a failure. After rewriting the FET failure flag, the CPU 222 executes finish processing or sleep transition processing for the image forming apparatus 1. When the +24V_A voltage is not output (Step S435: N), the CPU 222 determines that all the FETs 232, 233, and 234 are normally operating, and executes end processing or sleep transition processing for the image forming apparatus 1.

Another Example of Failure Identification Processing for FET

Figure 9:
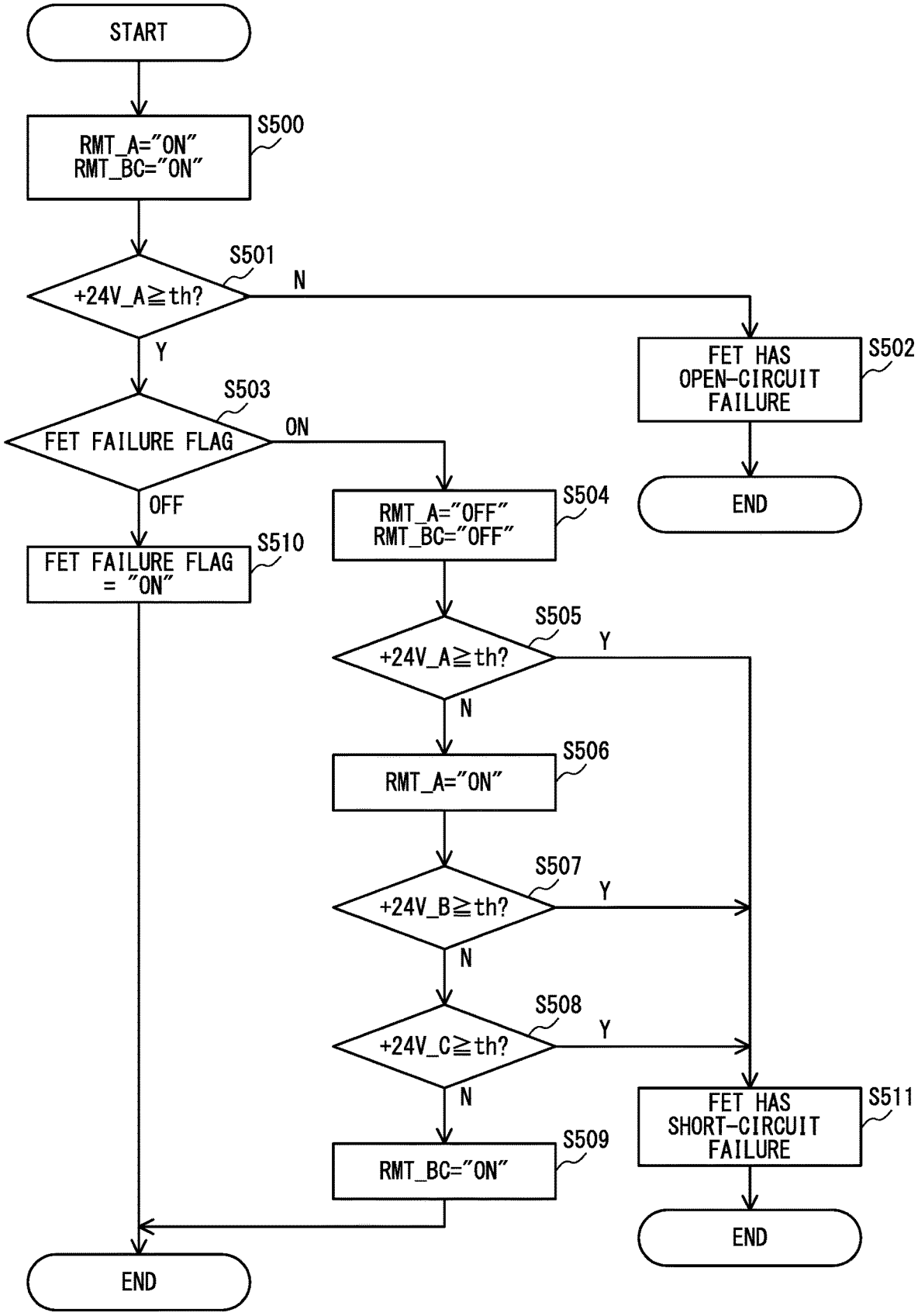
FIG. 9 is a flow chart for illustrating the failure identification processing for the FET.
Figure 10:
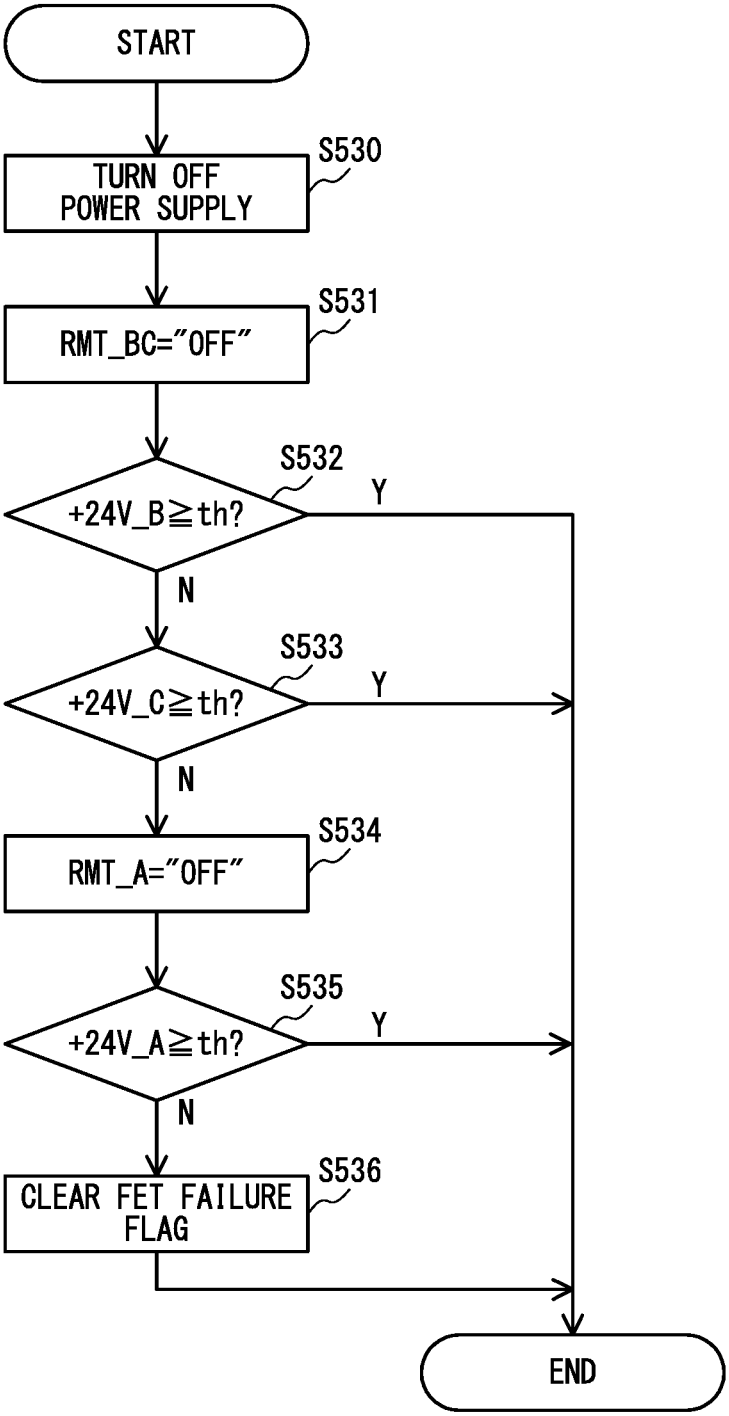
FIG. 10 is a flow chart for illustrating the failure identification processing for the FET.

FIG. 9 and FIG. 10 are flow charts for illustrating other failure identification processing for the FETs 232, 233, and 234 of the driver board 230. This processing is executed to ensure safety of the apparatus in each state of "power supply on" (activation) and "power supply off" (stop) of the image forming apparatus 1. The processing during operation of the image forming apparatus 1 is similar to that of the processing of FIG. 7.

FIG. 9 represents processing at the time of turning on of the power supply. This processing is executed by the user operating the main power supply switch of the image forming apparatus 1 and turning on the power supply.

Similarly to the processing of Step S400 and Step S401 of FIG. 6, the CPU 222 of the engine control board 220 turns on each of the FETs 232, 233, and 234, and determines whether the +24V_A voltage is normally output from the FET 232 (Step S500 and Step S501). When the +24V_A voltage is not normally output (Step S501: N), similarly to the processing of Step S402 of FIG. 6, the CPU 222 determines that the FET 232 has an open-circuit failure, and finishes the processing (Step S502).

When the +24V_A voltage is normally output (Step S501: Y), the CPU 222 checks the FET failure flag (Step S503). When the FET failure flag is off (Step S503: OFF), the CPU 222 turns on the FET failure flag (Step S510). That is, the CPU 222 rewrites the FET failure flag stored in the RAM 224 so that the FET failure flag is set to be on. At this time, when the FET failure flag is set to be on but the failure of each FET is not detected by the time when the power supply is turned off, the FET failure flag is set to be off at the time of turning off of the power supply. The CPU 222, which has rewritten the FET failure flag, executes the processing of activating the image forming apparatus 1.

When the FET failure flag is on (Step S503: ON), the CPU 222 determines whether there is a short-circuit failure of each of the FETs 232, 233, and 234 by processing similar to those of Step S404 to Step S409 and Step S411 of FIG. 6 (Step S504 to Step S509, and Step S511). After the CPU 222 turns on the FETs 233 and 234 installed at the subsequent stage of the FET 232 by the processing of Step S509, and has waited for a predetermined period of time (e.g., 300 milliseconds), the CPU 222 executes the processing of activating the image forming apparatus 1. In this processing, similarly to the processing of FIG. 6, the FET failure flag is not cleared, and set to be on.

In the processing at the time of activation described above, when the FET failure flag is off in the processing of Step S501, the CPU 222 does not execute the processing of Step S504 to Step S509. Thus, the image forming apparatus 1 is not required to perform diagnosis of the FETs 233 and 234 at the second stage at the time of activation, and executes activation at high speed in response to an operation of the main power supply switch. Meanwhile, when the CPU 222 determines that the FET has failed in processing of Step S502 and processing of Step S511, the CPU 222 notifies of a failure portion similarly to Step S306 of FIG. 4. With this, the FET that has failed is notified to the user or the support center. The image forming apparatus 1 detects a failure even when the main power supply switch is turned on/off until the FET that has failed is replaced (driver board 230 is replaced). When the FET that has failed is replaced, the image forming apparatus 1 executes the processing of Step S400 and subsequent processing again, whereas when there is no failure in the FET, the image forming apparatus 1 executes activation processing.

FIG. 10 represents processing to be executed at the time of turning off of the power supply of the image forming apparatus 1. Similarly to the processing of FIG. 8, this processing is executed by the user operating the main power supply switch and turning off the power supply, or when, for example, an instruction to form an image is not input for a predetermined period of time and the mode transitions to a sleep mode.

Similarly to the processing of Step S430 to Step S432 of FIG. 8, the CPU 222 of the engine control board 220 turns off the FETs 233 and 234 at the time of turning off of the power supply or at the time of transition to the sleep mode, and determines whether +24V_B voltage is output (Step S530 to Step S532). When the +24V_B voltage is output (Step S532: Y), the CPU 222 determines that the FET 233 has a short-circuit failure, and executes finish processing or sleep transition processing for the image forming apparatus 1.

When the +24V_B voltage is not output (Step S532: N), similarly to the processing of Step S433 of FIG. 8, the CPU 222 determines whether the +24V_C voltage is output from the FET 234 (Step S533). When the +24V_C voltage is output (Step S533: Y), the CPU 222 determines that the FET 234 has a short-circuit failure, and executes finish processing or sleep transition processing for the image forming apparatus 1.

Similarly to the processing of Step S434 and Step S435 of FIG. 6, when the +24V_C voltage is not output (Step S533: N), the CPU 222 turns off the FET 232, and determines whether +24V_A voltage is output (Step S534 and Step S535). When the +24V_A voltage is output (Step S535: Y), the CPU 222 determines that the FET 232 has a short-circuit failure, and executes finish processing or sleep transition processing for the image forming apparatus 1.

When the +24V_A voltage is not output (Step S535: N), the CPU 222 clears the FET failure flag (Step S536). That is, the CPU 222 rewrites the FET failure flag stored in the RAM 224 so that the FET failure flag is set to be off, which indicates that there is no failure. After the CPU 222 rewrites the FET failure flag, the CPU 222 executes finish processing or sleep transition processing for the image forming apparatus 1.

As described above, when an abnormality has occurred in the image forming apparatus 1, the image forming apparatus 1 determines whether the cause of the abnormality resides in the power supply system. When the cause of the abnormality resides in the power supply system, the image forming apparatus 1 identifies a component of the power supply system that has failed to cause the abnormality. As a result, working time for replacing parts by the service engineer is reduced.

Further, the image forming apparatus 1 according to this embodiment has a configuration in which the 24V power supply voltage is distributed to a plurality of power supply systems, and a plurality of FETs (power supply switching elements) are connected to each distribution destination. In such a configuration, the image forming apparatus 1 supplies an internal power supply voltage to a load corresponding to each of the plurality of power supply systems. Supply of the internal power supply voltage to each load is controlled independently for each power supply system by a plurality of power supply switching elements. At the time of activation, the image forming apparatus 1 performs diagnosis of an open-circuit failure of the power supply switching element at a first stage, which originally supplies power to each power supply system. Diagnosis of an open-circuit failure of other power supply switching elements is performed by failure diagnosis processing, which is executed when an abnormality has occurred in a load connected to the driver board 230. In this manner, through failure diagnosis of the power supply switching element, it is possible to shorten the period of time for activating the image forming apparatus 1 and identify the failure portion at the same time. As described above, according to at least one embodiment of the present disclosure, even with a configuration in which a plurality of power supply switching elements are installed in the power supply system, it is possible to perform failure diagnosis while at the same time reducing the activation period by performing failure diagnosis of only the first power supply switching element at the time of activation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2019-000644, filed Jan. 7, 2019 and No. 2019-201765, filed Nov. 6, 2019 which are hereby incorporated by reference herein in their entirety.

What is claimed is:

1. An image forming apparatus, comprising:

a power supply board including a power supply circuit configured to generate a power supply voltage;

a driver board including:

a plurality of switching elements each configured to supply and shut off a power supply for each of a plurality of distributed power supply voltages supplied from the power supply board; and a driver circuit configured to drive a plurality of loads for forming an image by the plurality of distributed power supply voltages; and an engine control board configured to control an operation of the driver board, wherein the plurality of switching elements include:

a first switching element, to which the power supply voltage is to be applied from the power supply board; and a second switching element, to which the power supply voltage output from the first switching element is to be applied in a distributed manner, and wherein the engine control board is configured to perform failure diagnosis of the first switching element when the image forming apparatus is activated, and perform failure diagnosis of the second switching element in a case where an abnormality has occurred in any one of the plurality of loads.

2. The image forming apparatus according to claim 1, wherein, when the image forming apparatus is activated, the engine control board causes the first switching element to be in a conductive state, and determines whether the first switching element has an open-circuit failure, which the first switching element is not become the conductive state, based on a voltage value of the power supply voltage output from the first switching element.

3. The image forming apparatus according to claim 1, wherein, when the image forming apparatus is activated, the engine control board causes the first switching element to be in a shut-off state, and determine whether the first switching element has a short-circuit failure, which the first switching element is not become the shut-off state, based on a voltage value of the power supply voltage output from the first switching element.

4. The image forming apparatus according to claim 3, further comprising a memory configured to store information indicating whether any one of the first switching element and the second switching element has failed, wherein, in a case where it is not determined that the first switching element has an open-circuit failure when the image forming apparatus is activated and information indicating a failure is stored in the memory, the engine control board determines whether the first switching element and the second switching element have a short-circuit failure.

5. The image forming apparatus according to claim 1, wherein, when the image forming apparatus is activated, the engine control board causes the first switching element to be in a conductive state and causes the second switching element to be in a shut-off state, and determines whether the second switching element has failed based on a voltage value of the power supply voltage output from the second switching element.

6. The image forming apparatus according to claim 1, wherein, in a case where the first switching element and the second switching element have not failed when the image forming apparatus is activated, the engine control board causes the first switching element and the second switching element to be in a conductive state, and executes processing of activating the image forming apparatus.

7. The image forming apparatus according to claim 1, wherein, in a case where an abnormality is detected in operation of any one of the plurality of loads at a time of forming an image by the one of the plurality of loads, the engine control board causes the second switching element to be in a conductive state, and determines whether the second switching element has an open-circuit failure based on a voltage value of the power supply voltage output from the second switching element.

8. The image forming apparatus according to claim 1, wherein, when the power supply of the image forming apparatus is turned off, the engine control board causes the first switching element to be in a conductive state and causes the second switching element to be in a shut-off state, and determines whether the second switching element has a short-circuit failure based on a voltage value of the power supply voltage output from the second switching element.

9. The image forming apparatus according to claim 1, wherein, when the power supply of the image forming apparatus is turned off, the engine control board causes the first switching element to be in a shut-off state, and determine whether the first switching element has a short-circuit failure based on a voltage value of the power supply voltage output from the first switching element.

10. The image forming apparatus according to claim 1, further comprising a memory configured to store information indicating whether any one of the first switching element and the second switching element has failed, wherein, when the power supply of the image forming apparatus is turned off, and any one of the first switching element and the second switching element has failed, the engine control board stores, into the memory, information indicating the failure.

11. The image forming apparatus according to claim 1, further comprising a memory configured to store information indicating whether any one of the first switching element and the second switching element has failed, wherein, when the power supply of the image forming apparatus is turned off, and the first switching element and the second switching element are normal, the engine control board stores, into the memory, information indicating that the first switching element and the second switching element have no failure.

* * * * *